United States Patent [19]

Nam

[11] Patent Number: 4,644,752

[45] Date of Patent: Feb. 24, 1987

[54] ENGINE SYSTEM FOR SHIPS

[76] Inventor: Chul W. Nam, No. 225-13, Sinwoul-Dong, Kangseo-ku, Seoul, Rep. of Korea

[21] Appl. No.: 735,244

[22] Filed: May 17, 1985

Related U.S. Application Data

[63] Continuation-in-part of Ser. No. 438,647, Nov. 3, 1982, Pat. No. 4,531,480.

[51] Int. Cl.[4] ..... F02B 73/00

[52] U.S. Cl. ..... 60/716; 60/616; 60/698; 123/19

[58] Field of Search ..... 60/400, 597, 616, 698, 60/716, 517, 525; 123/19, 52 B; 440/31

[56] References Cited

U.S. PATENT DOCUMENTS 4,070,860 1/1978 Hanson ..... 60/616
4,319,546 3/1982 Beden ..... 123/19

FOREIGN PATENT DOCUMENTS 3031872 4/1982 Fed. Rep. of Germany ..... 60/616

*Primary Examiner*—Stephen F. Husar
*Attorney, Agent, or Firm*—Armstrong, Nikaido, Marmelstein & Kubovcik

[57] ABSTRACT

An engine system for ships is has an engine body including a main combustion engine for generating power by igniting fuel and a power transmission apparatus for producing great power with the explosion pressure of the main combustion engine. A compressed air control device controls compressed air for reciprocating pumping piston of the power transmission apparatus. A booster is used to provide oil pressure to the power transmission apparatus. An accumulator is used to maintain constant oil pressure in the power transmission apparatus. A swash plate-type stirling engine is connected to a exhaust gas outlet of the main combustion engine. A turbo charger is used to force fresh air to the combustion chamber. A single-stage screw-type compressor is used to produce compressed air.

5 Claims, 11 Drawing Figures

ENGINE SYSTEM FOR SHIPS

CROSS REFERENCE TO RELATED APPLICATION

This application is a continuation-in-part of application U.S. Ser. No. 438,647 filed on Nov. 3, 1982, now U.S. Pat. No. 4,531,480.

BACKGROUND AND SUMMARY OF THE INVENTION

This invention relates to an engine system for increasing net thermal efficiency of main ship engines, in particular to an engine system for increasing net thermal efficiency of two-cycle Diesel engines.

For increasing net thermal efficiency, U.S. patent application Ser. No. 438,647, now U.S. Pat. No. 4,531,480, addressed the problem of pressure produced by gas expansion in piston power transmission apparatus of conventional internal combustion engines.

In other words, the engine disclosed in said invention was designed to increase the force acting on the cross-sectional area of the piston, thereby enhancing the power output of the engine system by applying basic principles of fluid mechanics and taking into account the difference of cross-sectional areas between the top and bottom pistons. Further, oil in the hollow chamber is used for producing pressure by means of cylinder functioning as an oil pump during the power stroke.

Therefore, the constant pressure produced by gas explosion is applied to the top piston. Then the force exerted on the cross-sectional area of the top piston is transferred through the oil chamber and then converted to mechanical energy forcing the bottom piston downward. Thus the force exerted on the cross-sectional area of the bottom piston is multiplied in proportion to the cross-sectional areas of the top and bottom pistons. But it is noted that the stroke distance of the bottom piston is not sufficient to reach BDC.

Accordingly, the engine disclosed in said invention provides a ring-type piston in the external chamber of the upper cylinder block.

The ring-type piston is operated to compensate for the insufficient stroke distance as soon as the pressure in the cylinder chamber drops below the pressure of the outer compressed air storage.

Consequently the greatly increased force is applied to the bottom piston and is transferred to the crank shaft by means of the connecting rod.

However in the cited invention, the pumping of oil to produce additional power involves a great deal of sliding motion of the top piston, therefore temperature rise of the oil is inevitable despite the presence of a water jacket around the cylinder block for cooling.

Furthermore, oil leaks into the combustion chamber despite the presence of a piston ring, oil ring and seal ring installed within the ring grooves of the top piston and despite precision tooling of the top piston and cylinder wall.

As is obvious, there are many problems with said invention including incomplete combustion, atmospheric pollution, overheating, oil leakage, etc.

Accordingly, the object of this invention is to provide an engine system for ships for increasing net thermal efficiency of two-cycle diesel engines.

The main engine body of this invention is comprised of a main combustion chamber for generating power and a power transmission apparatus for transferring the greater power produced in the main combustion chamber to the power crank shaft.

Another object of this invention is to provide a swash plate-type stirling engine and a single-stage screw-type compressor for compressing air by utilizing heat of exhaust gas ignited in the main combustion chamber.

A further object of this invention is to provide a compressed air control device for properly adjusting the application of compressed air to the top piston of power transmission apparatus.

A further object of this invention is to provide a booster for supplying oil pressure to the external chamber of the power transmission apparatus, in which oil pressure is produced by a compressed air storage in order to compensate for insufficient oil pressure of the power cylinder.

A further object of this invention is to provide a long rod between the combustion chamber piston and pumping piston so as to directly transfer the explosion pressure of the combustion chamber to the pumping piston in the power transmission apparatus.

A further object of this invention is to provide four orifices which act as a buffer spacer in the rod guide by the circulation of oil in the power cylinder.

In order to achieve the above-mentioned objects, this invention comprises a main combustion engine, a power transmission apparatus, one or more swash plate-type stirling engines, a single-stage screw-type compressor a compressed air storage, a booster, an accumulator, and a compressed air control device.

Said combustion engine has a combustion chamber piston which works with a sliding and reciprocating motion in the combustion chamber, a long rod which is connected to the bottom of said combustion chamber piston, and two upper connecting rods which are connected between said long rod and two cranks in the combustion chamber. The power transmission apparatus comprises a pumping piston, a power piston, a pumping cylinder block, and a power cylinder block. Said pumping piston in the pumping cylinder works with a sliding and reciprocating motion which is timed with the same stroke as the combustion chamber piston of the main combustion engine, and said power piston works with a sliding and reciprocating motion which is timed with the same stroke is the pumping piston, and a rod guide which shields an end of said long rod is fixed to the center of the power piston, and said power piston is connected to a power connecting rod which transfers rotation power to the power crank shaft, and a pumping cylinder block is composed of a pumping cylinder chamber and an external chamber, and the intake and exhaust passages for intake and exhaust of compressed air to the top of pumping piston and oil reciprocating passages for holding the oil pressure constant within the oil chamber are formed in the pumping cylinder block. In said pumping cylinder chamber the pumping piston works with a sliding and reciprocating motion and the external chamber is formed as a circular column around the pumping cylinder, and in the power cylinder chamber of the power cylinder block the power piston works with a sliding and reciprocating motion, further the cross-sectional area of the power piston is greater than that of the pumping piston.

Said swash plate-type stirling engine is attached to the exhaust gas outlet of the main combustion engine and is operated by utilizing exhaust gas heat of the main combustion engine.

Said single-stage screw-type compressor which is connected to said swash plate-type stirling engine is used to generate a great deal of compressed air.

Said compressed air storage is used to store a great deal of compressed air generated by said single-stage screw-type compressor.

Said booster is used to generate greater oil pressure by the compressed air of the said compressed air storage.

Said accumulator which is operated by compressed air of said compressed air storage is used to provide constant oil pressure to said power transmission apparatus.

Said compressed air control device is used for intake and exhaust of compressed air to the pumping piston of said power transmission apparatus.

The above and other objects of this invention will be seen by reference to the description explained in connection with the accompanying drawings, in which.

Figure 1:
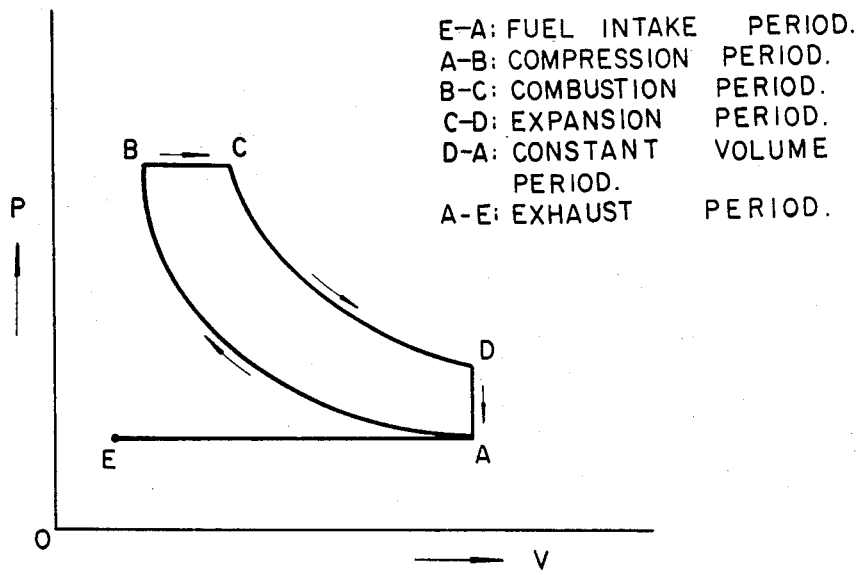
FIG. 1 illustrates the P-V relationship of the conventional two-cycle Diesel engine.

In the relationship of conventional two cycle Diesel engines as shown in FIG. 1, (E–A) represents the period of fuel intake in constant-pressure, (A–B) represents the period of adiabatic compression, (B–C) represents the period of isobaric combustion, (C–D) represents the period of adiabatic expansion, (D–A) represents the period of radiation in constant-volume, (A–E) represents the period of exhaust in constant-pressure.

The two-cycle Diesel engine of this invention is composed of two adiabatic processes, a constant-volume process, a isobaric process and two constant-pressure processes.

Unlike four-cycle Diesel engines which have individual intake, compression, explosion and exhaust strokes, the two-cycle Diesel engine does not have so clearly defined strokes, and intake and compression strokes take place simultaneously just as do the explosion and exhaust strokes, that is, when the crank shaft rotates one time, one cycle is completed and thus two-cycle Diesel engines can achieve greater rotational power than four-cycle Diesel engines.

If the rotation speed and net average effective pressure of a two-cycle Diesel engine are equivalent to the rotation speed and net average effective pressure of the four-cycle Diesel engine, the power of the two-cycle Diesel engine is two times greater than that of a four-cycle Diesel engine.

Figure 2:
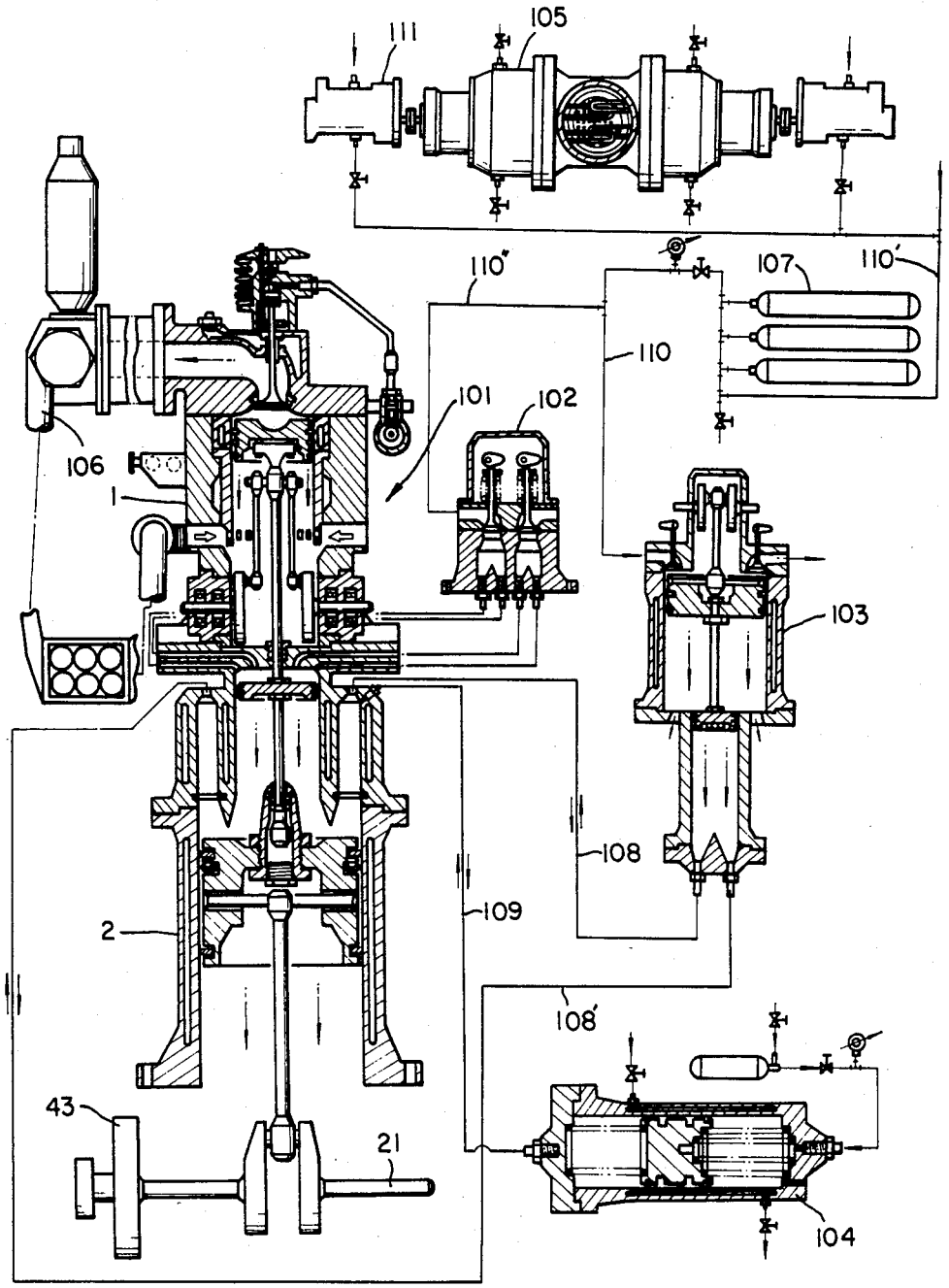
FIG. 2 is a block diagram showing the embodiment of this invention.

In the engine system in accordance with the embodiment of the invention as shown in FIG. 2, main engine body 101 comprises main combustion engine 1 which generates power by igniting fuel and power transmission apparatus 2 which produces great power with the explosion pressure of said main combustion engine 1, the compressed air control device 102 controls the compressed air for moving the pumping piston of the power transmission apparatus 2 downward, booster 103 is used to provide oil pressure to said power transmission apparatus, accumulator 104 maintains constant oil pressure to the power transmission apparatus, swash plate-type stirling engine 105 is connected to the exhaust gas outlet of said main combustion engine 1, turbo charger 106 is used to supply the combustion chamber of main combustion engine 1 with fresh air, single-stage screw-type compressor 111 is used to produce compressed air, compressed air storage 107 is used for storing compressed air, booster 103 and accumulator 104 are connected to the outer chamber of the power transmission apparatus 2 by individual hydrostatic pipes 108, 108', 109, said single-stage screw-type compressor 111 which is connected by a coupling to the swash plate-type stirling engine 105 is used to supply compressed air to booster 103 through compressed air pipe 110, 110', the compressed air which is produced by the single stage screw-type compressor 111 is stored in compressed air storage 107 which is located between said compressed air pipes 110 and 110'. Further the compressed air is supplied to the upper portion of pumping piston 19, thus explosion pressure as well as compressed air are applied to the pumping piston.

According to the above-mentioned constitution, the engine system of this invention is as follows. The engine system utilizes exhaust gas heat which is discharged from the combustion chamber of main combustion engine 1, swash plate-type stirling engine 105 is operated by the exhaust gas, and single stage screw-type compressor 111 which is attached to stirling engine 105 produces compressed air. This compressed air is applied to booster 103 through compressed air pipes 110, 110', said booster which produces greater oil pressure applies oil pressure to the external chamber of power cylinder block 18, while at the same time a portion of said compressed air is also applied to the upper portion of the pumping piston of said power transmission apparatus 2 through compressed air pipes according to the intake and exhaust valve of said compressed air control device 102, thus the power applied to the power transmission apparatus results from the explosion pressure of the combustion chamber together with the compressed air which is applied to the pumping piston.

Figure 3:
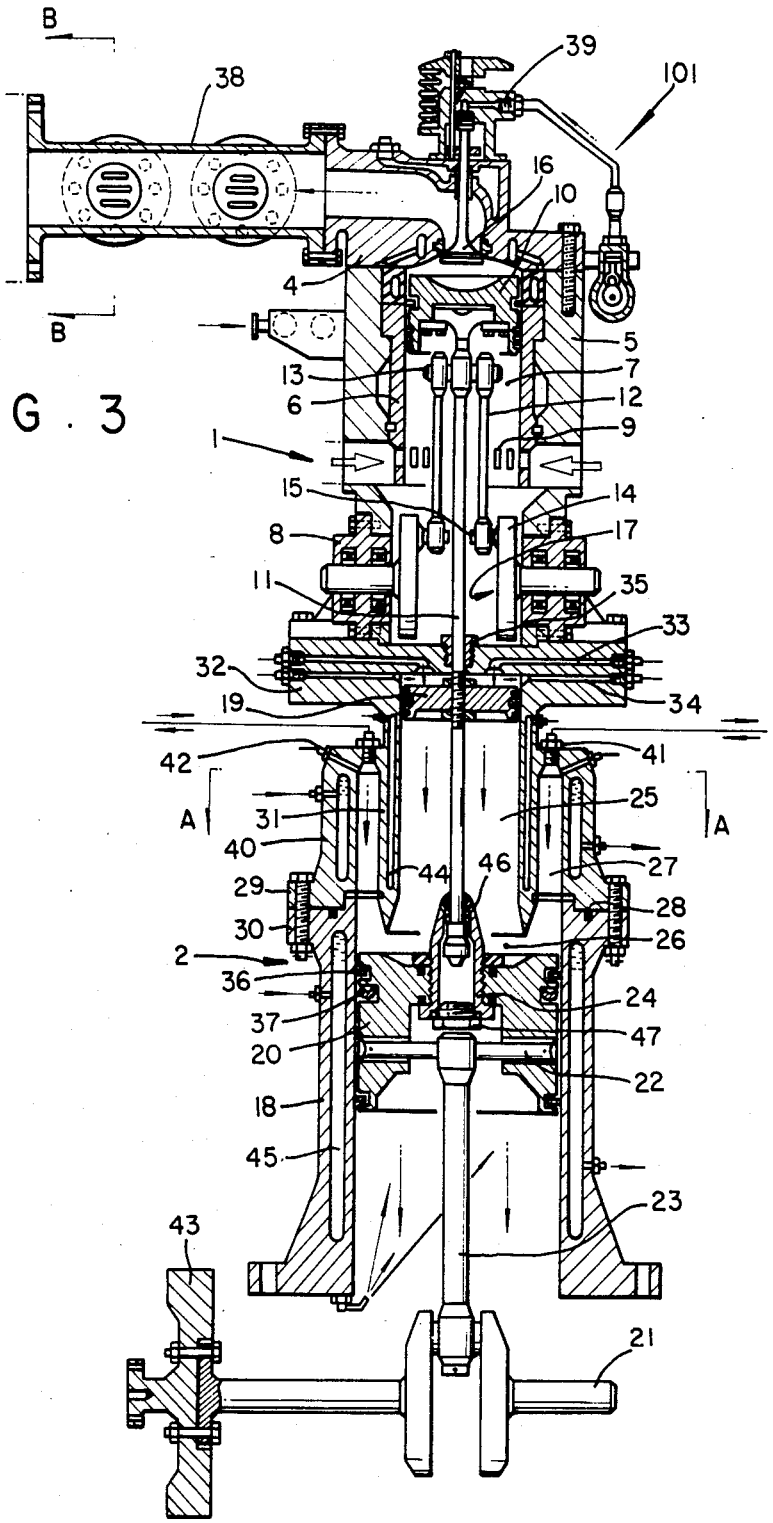
FIG. 3 is a cross-sectional view of the engine body in accordance with this invention.
Figure 4:
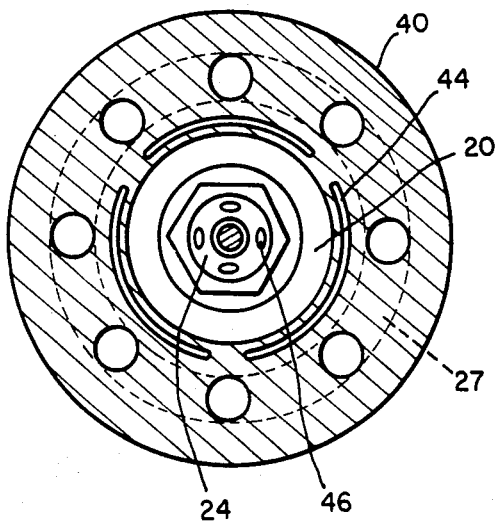
FIG. 4 is a cross-sectional view of line A—A of FIG. 3.

As shown in FIGS. 3 and 4, the engine body is composed of main combustion engine 1 which is a conventional two-cycle Diesel engine and power transmission apparatus 2 which is operated by the explosion pressure of the main combustion engine, by the oil pressure of the pumping piston and by the oil pressure of the booster, and the main combustion engine is coupled to the power transmission apparatus by a flange.

In the main combustion engine 1, cylinder liner 6 of combustion cylinder block 5 has holes 9 for intake, in which the combustion chamber piston works with a sliding and reciprocating motion. And bearing block 8 which is used to support two crank assemblies 17 at both sides of long rod 11 is fixed to cylinder block 5 by bolts.

Air passing through air cooler by means of air intake pipe goes to the main combustion chamber through the several holes formed in the bottom portion of liner 6 for the intake stroke.

Combustion chamber piston 10 which is supported by piston ring, oil ring and side wall of cylinder liner 6 and which works with a sliding and reciprocating motion in the cylinder liner 6 of the combustion chamber is connected to pumping piston 19 by long rod 11 attached to its base. And one end of upper connecting rod 12 is able to rotate by insertion of pin 13 into the upper portion of long rod 11, the other end of upper connecting rod 12 is assembled to crank pin 15 of crank 14. Thus crank assembly 17 rotates by means of upper connecting rod 12 when combustion chamber piston 10 moves downward in the expansion stroke. The combustion chamber is cooled by a water jacket which is installed between cylinder liner 6 and cylinder block 5 of main combustion engine 1. A gasket is inserted between cylinder head 4 and cylinder block 5 which are joined with bolts, and connecting pipe 38 is fixed between the exhaust gas outlet formed in cylinder head 4 and the swash plate-type stirling engine 105, and exhaust gas which is discharged to operate said stirling engine through connecting pipe 38 is controlled by exhaust gas valve 16, and said exhaust gas valve 16 is opened and shut by hydrostatic device 39 in the upper portion of cylinder head 4.

In power transmission apparatus 2, flange 29 of pumping cylinder block 40 and flange 30 of power cylinder block 18 are bolted together, pumping cylinder block 40 is provided with a ring-shaped wall 31 which forms pumping cylinder 25, and a water jacket 44 which surrounds ring-shaped wall 31. Also, upper flange 32 of cylinder block 40 is provided with an intake passage 33 and an exhaust passage 34 which are compressed air passages providing intake and exhaust channels from compressed air control device 102 to the top of pumping piston 19, the center of pumping cylinder 25 is provided with rod guide 24. Pumping piston 19 in pumping cylinder 25 is bolted to long rod 11 mounted at the bottom of combustion chamber piston 10 in the combustion chamber, and the other end of long rod 11 is inserted into rod guide 24 which is bolted in the center of power piston 20. A space between power piston 20 and rod guide 24 is sealed by an "O"-Ring, long rod 11 is slidably housed in rod guide 24. The top of rod guide 24 is provided with four orifices 46, and when long rod 11, is moved in rod guide 24, the oil reciprocating through the four orifices absorbs the shock produced by long rod 11 and a hole formed at the center of rod guide 24 is sealed by a bolt having an "O"-Ring, and thus the oil in the power cylinder does not leak into the bottom of power piston 20.

External chamber 27 formed by means of ring-shaped wall 31 is an oil passage, into which oil flows from booster 103. The top of external chamber 27 is provided with oil pipe fittings 42 in order to maintain oil pressure in pumping cylinder 25, external chamber 27 and power cylinder 26, and oil pipe fittings 42 are communicated with the accumulator 104 through the oil pipe 109. Power piston 20 in power cylinder 26 is connected to long rod 11 by rod guide 24 and is connected to power crank shaft 21 by piston pin 22 and power connecting rod 23.

To prevent oil leakage between the power piston and the power cylinder wall, a piston ring 36 and a seal ring 37 are inserted into the ring grooves of power piston 20. The power cylinder block 18 is provided with a water jacket 45 so that the oil in power cylinder 26 is not overly heated by friction.

Power crank shaft 21 is connected to power piston 20 by means of power connecting rod 23. Crank shaft 21 is installed to the crank shaft bearing block. Flywheel 43 is installed to increase the torque of power crank shaft 21.

Figure 5:
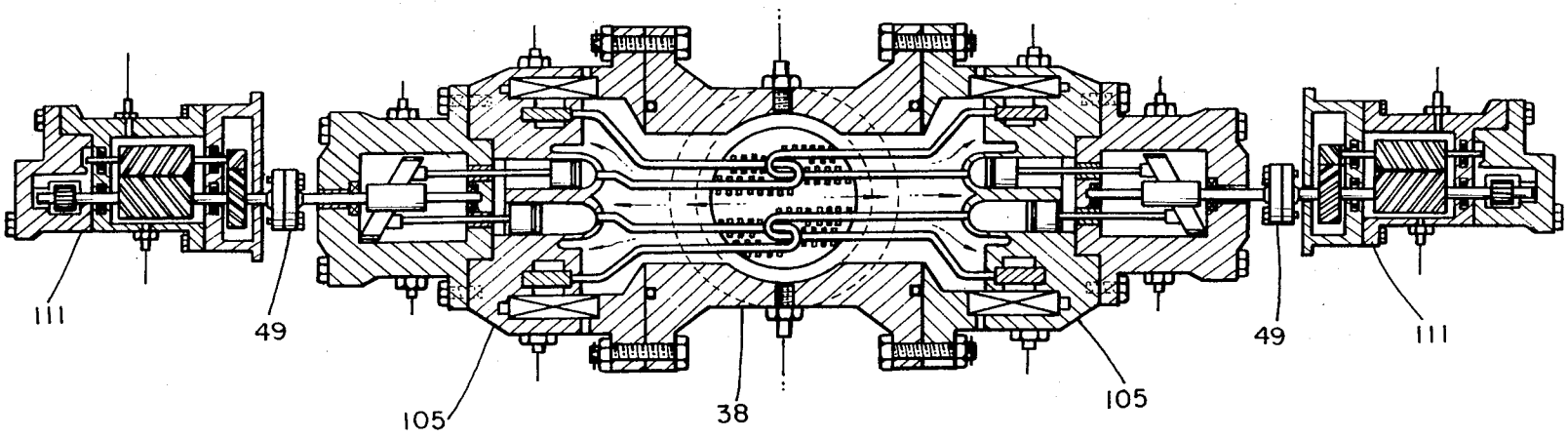
FIG. 5 is a cross-sectional view of line B—B of FIG. 3 showing a swash plate-type stirling engine and a single stage screw-type compressor used in the embodiment of this invention.

FIG. 5 shows a swash plate-type stirling engine 105 and a single-stage screw-type compressor 111 used to produce a great deal of compressed air by utilizing exhaust gas heat. The swash plate-type stirling engine 105 converts exhaust gas heat to mechanical energy by expanding hydrogen gas, and in this invention one or more stirling engines are effectively used so that a great deal of the compressed air is produced, and exhaust gas which is passed through the stirling engine is supplied to the combustion chamber and economizer.

This swash plate-type stirling engine has a drive shaft, which is attached with a single-stage screw-type compressor via coupling 49, and the compressed air generated by a compressor 111 is stored in compressed air storage 107 through compressed air pipe 110'.

Figure 6:
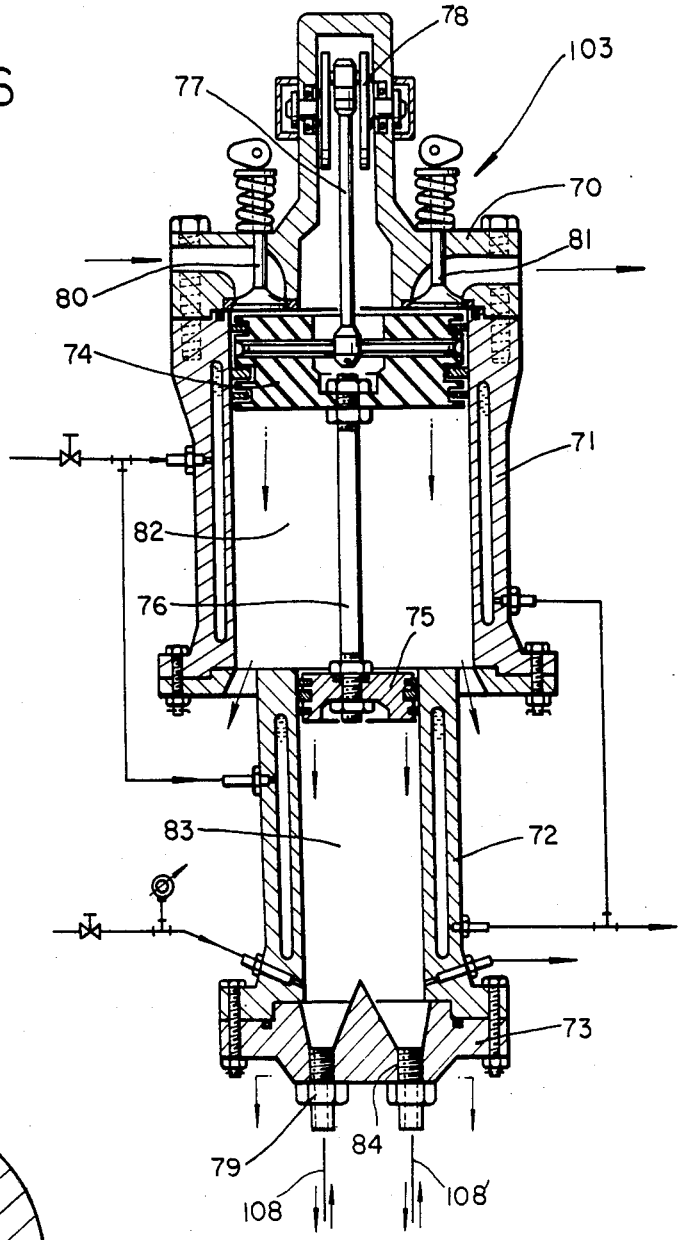
FIG. 6 is a cross-sectional view of the booster used in the embodiment of this invention.
Figure 7:
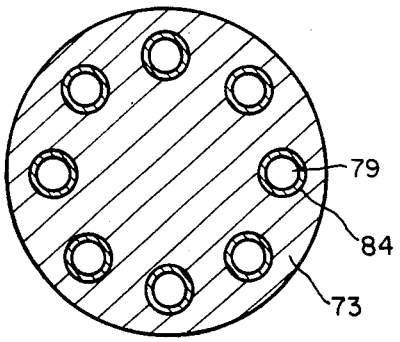
FIG. 7 is a bottom plane view of FIG. 6.

As shown in FIGS. 6 and 7, booster 103 which provides oil pressure for completing the stroke of power piston 20 in power transmission apparatus 2 supplies oil pressure to the external chamber of pumping cylinder block 40 through eight oil pipe fittings 79. Thus the oil pressure generated from booster 103 is applied to power piston 20 in the power transmission apparatus, and intake and exhaust valves 80, 81 are attached to the upper portion of booster 103, thereby transmitting air into the upper piston 74 of booster 103 which has a larger cross-sectional area than that of the bottom piston of the booster. And in the booster, rod 76 is inserted between compressed air piston 74 and oil piston 75, and the cross-sectional area of compressed air piston 74 is greater than that of oil piston 75. Further, compressed air cylinder block 71 is connected to oil cylinder block 72 with a flange, and oil in oil cylinder 83 flows into and out of external chamber 27 in power transmission apparatus 2 through oil pipes 108, 108', and crank 78 in booster 103 is connected to compressed air piston 74 in the upper portion of booster 103 through connecting rod 77.

As shown in FIG. 3, booster 103 supplies oil to the power cylinder block 18 so as to increase oil pressure therein, and said booster 103 is operated by compressed air which is controlled by intake and exhaust valves 80, 81 in cylinder head 70 of booster 103.

In particular, crank 78 which is connected to the upper piston by connecting rod 77 is installed in order to insure smooth operation of the booster at high speeds.

Figure 8:
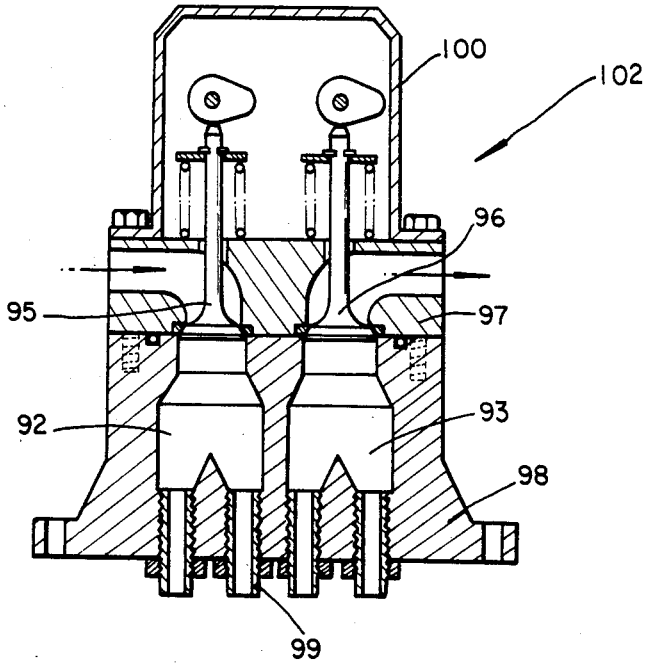
FIG. 8 is a cross-sectional view of the compressed air control device used in the embodiment of this invention.
Figure 9:
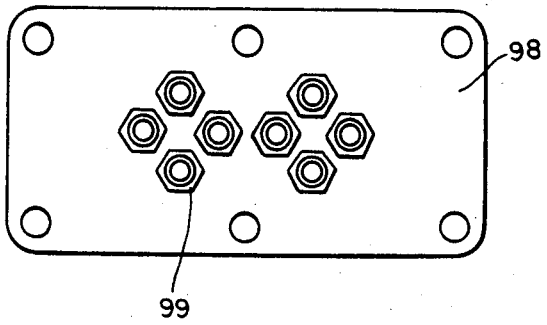
FIG. 9 is a bottom plane view of FIG. 8.
Figure 10:
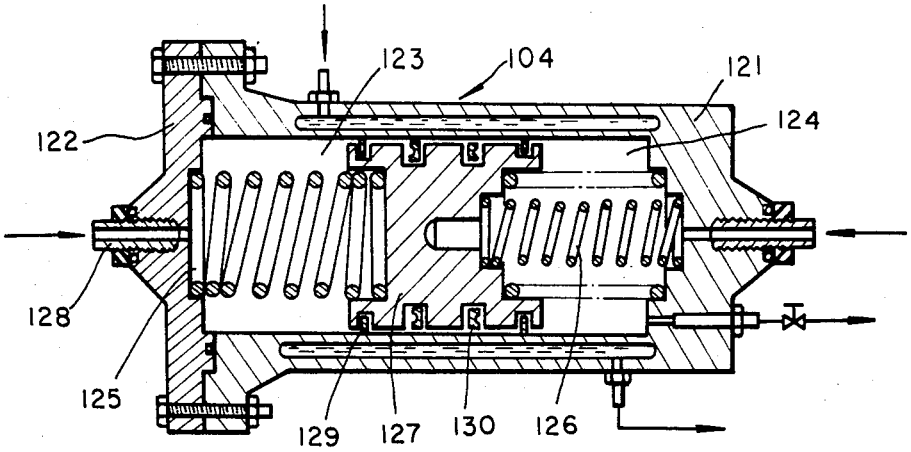
FIG. 10 is a cross-sectional view of the accumulator used in the embodiment of this invention.

FIGS. 8 and 9 show the compressed air control device 102 for intake and exhaust of compressed air into the upper portion of pumping piston 19 in the power transmission apparatus 2. Upper cylinder block 97 is provided with intake and exhaust valves 95, 96 which permit the compressed air in the compressed air storage 107 to enter and exit. Lower block 98 is provided with intake chamber 92 and exhaust chamber 93 which have four compressed air pipe fittings 99 respectively, and the flange of upper block 97 is bolted to the upper flange of lower block 98, and upper block 97 is covered by cap 100. As shown by FIG. 10, accumulator 104 comprises a body 121 and a flange 122, and said body 121 has cylinder 123, 124 which contain a balancing piston 127 and coil springs 125, 126, and a flange 122 have an oil pipe fitting 128, and an O-ring is inserted between body 121 and flange 122 which are attached by bolts. Said body 121 is separated into an oil cylinder 123 and a compressed air cylinder 124 by means of balancing piston 127, said balancing piston 127 is provided with ring grooves which permit insertion of piston ring 129 and seal ring 130. Oil cylinder 123 is communicated with the power transmission apparatus 2 through oil pipe 109, and compressed air cylinder 124 is communicated with an external compression air tank through compressed air pipe.

Figure 11:
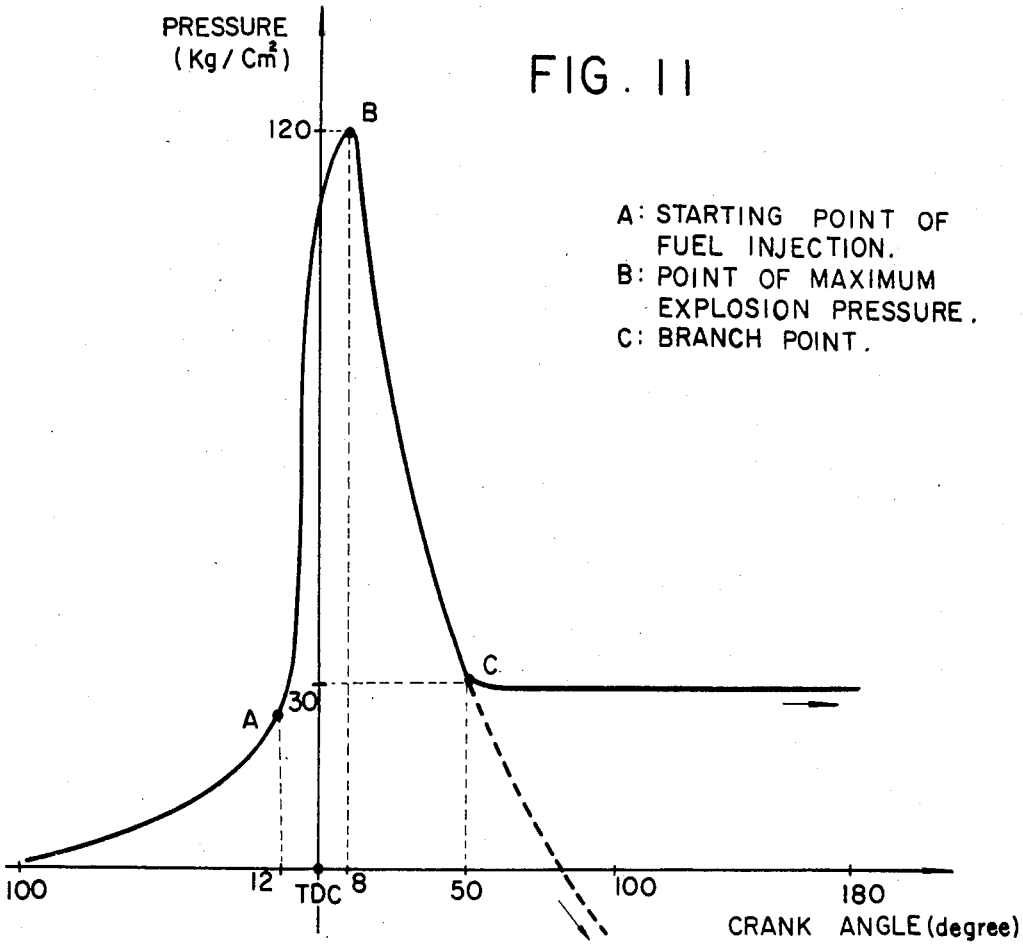
FIG. 11 is a chart showing the relationship of crank angle, measured in degrees, and combustion chamber pressure.

FIG. 11 shows the relationship of crank piston and combustion chamber pressures. In FIG. 11, A is the starting point of fuel injection, that is at 12° before TDC, and B is the point of maximum gas pressure that is 120 kg/cm$^2$, and C is the branch point between minimum pressure of this invention and pressure drop of conventional two-cycle Diesel engines.

In the conventional two-cycle Diesel engine, pressure of the combustion chamber drops rapidly after the explosion stroke, but in this invention the minimum pressure is maintained at 30 kg/cm$^2$ by means of the operation of the booster.

The operation of the above described mechanism and further constructional features and advantages will be best appreciated from a description of the operation commencing with the mechanism shown in the Drawings. First, in order to drive the main combustion engine, a starting air valve (not shown) at the top of combustion chamber 7 is opened, then compressed air of 30 kg/cm$^2$ flows from the compressed air tank into the combustion chamber so that piston 10 moves downward. As piston 10 moves downward, two crank assemblies 17 which are connected to upper connecting rod 12 by crank pin 15 are rotated by upper connecting rod 12 in both ends of connecting pin 13. At the same time, pumping piston 19 which is fixed to rod 11 moves downward. At this time the intake valve of the compressed air control device 102 is opened at 50° after TDC, and compressed air of 30 kg/cm$^2$ flows into pumping cylinder 25 through the intake passage, thus the pumping piston is compressed by the compressed air. Further, pumping piston 19 has compressed air pressure of 30 kg/cm$^2$ even if the explosion pressure of the main combustion chamber 7 drops off rapidly. As pumping piston 19 of the power transmission apparatus 2 moves downward, oil in the pumping cylinder 25 is compressed and is forced against power piston 20.

Booster 103 applies oil pressure to power cylinder 26 when the crank passes through 50° after TDC, thus power piston 20 reaches BDC after combustion chamber piston 10 reaches bottom dead center(BDC), and power piston 20 starts rising upward because of the inertial force of flywheel 43 which is fixed to power crank shaft 21, and at the same time the air in the combustion chamber is compressed by the rising motion of combustion chamber piston 10. When pumping piston 19 moves upward, the exhaust valve of compressed air control device 102 is opened at 6° after BDC and the intake valve is shut at 10° after BDC, and compressed air which flows into pumping cylinder 25 is discharged into the atmosphere through the exhaust port, and two-thirds of the oil which is exerted downward to move the power piston is filled into pumping cylinder 25 and the other one-third of the oil is filled into external chamber 27 and returns to oil cylinder 83 of booster 103. Fuel is injected at 6° to 12° before top dead center(TDC) and ignites in the combustion chamber, and combustion chamber piston 10 moves downward by the explosion pressure, and at this time the intake valve of compressed air control device 102 is opened at 50° after TDC, and air pressure of 30 kg/c$^2$ is applied to the upper portion of the pumping piston, and thus oil which is in pumping cylinder 25 of power transmission apparatus 2 is compressed. Therefore pumping piston 19 of pumping cylinder 25 moves downward with the explosion pressure and air pressure, and oil in pumping cylinder 25 flows into power cylinder 26 so that power piston 20 begins a downward motion. Intake valve 80 in the upper portion of booster 103 is opened at 50° after TDC, and oil pressure of 30 kg/cm$^2$ which is produced in booster 103 is exerted to power piston 20, said power piston 20 reaches BDC, and thus the explosion stroke is completed.

Also, during the period of the explosion stroke, combustion piston 10 of main combustion engine 1 moves downward by the explosion pressure, and exhaust valve 16 is opened before the intake port of combustion chamber wall 6 is opened, thus exhaust gas in the combustion chamber 7 is discharged to the outside of combustion chamber 7 through the exhaust gas outlet. At this time, the intake port of the combustion chamber is opened, and fresh air is supplied into the combustion chamber 7 by means of the turbo charger 106, and then the remaining exhaust gas in the combustion chamber is discharged. Accordingly the power and exhaust strokes are completed at the same time. When the combustion chamber piston 10 moves up to TDC, the intake port and exhaust valve are closed, therefore the air in the combustion chamber 7 is compressed. At this time, the operation of the main combustion engine 1 and power transmission apparatus 2 continues as above mentioned. Exhaust gas discharged at the combustion chamber 7 of the main combustion engine 1 drives the swash plate-type stirling engine 105, thereby the single-stage screw-type compressor 111 which is connected by coupling 49 to the stirling engine produces a great deal of compressed air, and this compressed air is introduced to booster 103 through compressed air pipe 110 and 110', and also this compressed air is introduced into the pumping cylinder 25 of the power transmission apparatus 2 through the other pipe 110'' which is separated with the compressed air pipe, and the compressed air control device 102 exerts pressure forcing the pumping piston 19 downward. Also, the exhaust gas discharged after driving the swash plate-type stirling engine 105 also drives the turbo charger 106, and by heat exchange of the economizer the boiler is driven and thereby generates a large quantity of steam. This steam drives the steam turbine so as to provide a great deal of compressed air. Meanwhile, as the above mentioned operation continues, the accumulator 104 which is connected by an oil pipe 109 to the pumping cylinder block is operated by compressed air from the compressed air tank so as to maintain constant oil pressure and oil quantity within the pumping cylinder block 40.

The main engine system of two-cycle Diesel engine for ships is provided with the above mentioned structure and operation. As illustrated by the solid line in FIG. 11, torque of the power crank shaft in conventional two-cycle Diesel engines may be maximized at 8° to 10° after TDC and starts to decrease rapidly at 20° after TDC, thus rotational force of the crank shaft decreases because of decreasing explosion pressure.

In this invention explosion pressure in the main combustion chamber is maximized at 8° to 10° after top dead center(TDC) as in a conventional engine, but when gas pressure decreases to almost 30 kg/cm$^2$ at 50° after TDC, the upper portion of the pumping piston in the power transmission apparatus has an outer pressure of 30 kg/cm$^2$, and the pumping piston has continuously constant pressure, and thus this invention prevents pressure of the combustion chamber from dropping. And the cross-sectional area of the power piston is greater than that of the pumping piston. The power crank shaft is rotated with a greater pressure as compared with the pumping piston pressure, thus the rotational force of the power crank shaft is very great as compared to that of the combustion chamber crank shaft. And net thermal efficiency of the main combustion engine is improved by almost 83%.

Another advantage of this invention is that it utilizes the exhaust gas heat of high temperature which is discharged from the main combustion engine. A swash plate-type stirling engine is driven with the exhaust gas, said exhaust gas is supplied to the turbo machine and then is supplied to the economizer by means of heat exchange, and thus the economizer produces a great deal of steam by which the steam turbine is driven. Further, said steam turbine produces a great deal of compressed air.

It will be obvious to those skilled in the art that the application of this invention is not limited strictly to two-cycle Diesel engines for ships, and that various changes and modifications may be made in this invention without departing from the spirit and scope thereof.

What is claimed is:

1. An engine system for ships, comprising:

an engine body including a main combustion engine for transmitting the power generated by explosion pressure to a pumping piston and a power transmission apparatus for transmitting to a power crank shaft the power that is increased by the ratio of the cross-sectional areas of a combustion chamber piston to a power piston, wherein the stroke distance of the combustion chamber piston is equal to that of the power piston;

one or more swash plate-type stirling engines coupled to the exhaust gas outlet of the main combustion engine to be driven by the exhaust gas heat;

a single-stage screw-type compressor coupled by the drive shaft to the swash plate-type stirling engine, thereby generating a great amount of compressed air;

a compressed air source connected to said compressor for storing a great amount of compressed air from said compressor;

a booster connected between said compressed air source and said power transmission apparatus to amplify the air pressure derived from the compressed air source and then to provide the amplified air pressure to said power transmission apparatus by operation of the cam in accordance with the rotation of a crank shaft;

an accumulator in communication with said power transmission apparatus through a fluid oil pipe, thereby maintaining constant control of the oil pressure in said power transmission apparatus; and a compressed air control device for intake and exhaust of compressed air which is added and released to/from the pumping piston of said power transmission apparatus.

2. An engine system for ships in accordance with claim 1, wherein said main combustion engine has a configuration in which a relatively longer connecting rod is connected to the lower end of the combustion chamber piston and two wheel-type crank shafts are connected to each of two relatively short connecting rods.

3. An engine system for ships in accordance with claim 1, wherein said power transmission apparatus has a configuration in which the upper flange of a pumping cylinder block is provided with an intake passage and an exhaust passage for intake and exhaust of air into/from the compressed air control device to the top of the pumping cylinder.

4. An engine system for ships in accordance with claim 1, wherein more than one of said swash plate-type stirling engines are coupled in opposition to each other by a connecting pipe and operated by exhaust heat.

5. An engine system for ships in accordance with claim 1, wherein said compressed air control device has a configuration, in which an upper cylinder block of said compressed air control device has an intake and an exhaust valve so that the compressed air in the compressed air storage source is allowed to enter and exit, and a lower cylinder block of said compressed air control device has an intake chamber and an exhaust chamber which have four compressed air pipe fittings respectively, and an upper flange of the lower block is bolted to the lower flange of the upper cylinder block, and the upper cylinder block is covered by a cap.

* * * * *